US005732427A

United States Patent [19]

Parnham

[11] Patent Number: 5,732,427

[45] Date of Patent: Mar. 31, 1998

[54] HEIGHT ADJUSTABLE PILLOW

[75] Inventor: Leon Parnham, Brighton, Australia

[73] Assignee: Parnham & Associates Pty Ltd. Australia

[21] Appl. No.: 682,758

[22] PCT Filed: Nov. 24, 1994

[86] PCT No.: PCT/AU94/00726

§ 371 Date: Jul. 31, 1996

§ 102(e) Date: Jul. 31, 1996

[87] PCT Pub. No.: WO95/26154

PCT Pub. Date: Oct. 5, 1995

[30] Foreign Application Priority Data

Mar. 29, 1994 [AU] Australia ..... PM4747

[51] Int. Cl.[6] ..... A47C 20/02

[52] U.S. Cl. ..... 5/640; 5/657

[58] Field of Search ..... 5/636, 640, 722, 5/740, 655.9, 657, 727–730

[56] References Cited

U.S. PATENT DOCUMENTS

| | | | |
|---|---|---|---|
| D. 339,020 | 9/1993 | Ward et al. . | |
| 2,234,506 | 3/1941 | Sistig . | |
| 3,243,828 | 4/1966 | McCarty | 5/636 |
| 3,829,917 | 8/1974 | De Laittre | 5/636 |
| 4,214,326 | 7/1980 | Spann | 5/632 |
| 4,574,411 | 3/1986 | Yagi . | |
| 4,777,855 | 10/1988 | Cohen | 5/636 |
| 4,899,405 | 2/1990 | Rothbard . | |
| 4,916,765 | 4/1990 | Castronovo, Jr. . | |
| 4,918,774 | 4/1990 | Popitz . | |
| 4,959,880 | 10/1990 | Tesch . | |
| 5,153,960 | 10/1992 | Ritter | 5/640 |
| 5,285,944 | 2/1994 | Green et al. . | |
| 5,533,218 | 7/1996 | Fahy | 5/636 |

FOREIGN PATENT DOCUMENTS

| | | |
|---|---|---|
| 33175/93 | 9/1993 | Australia . |
| 2435236 | 4/1980 | France . |
| 3819494A1 | 12/1989 | Germany . |
| 995108 | 6/1965 | United Kingdom . |
| 999217 | 7/1965 | United Kingdom . |
| 2 134 383 | 8/1984 | United Kingdom . |
| WO 91/03193 | 3/1991 | WIPO . |

*Primary Examiner*—Flemming Saether
*Attorney, Agent, or Firm*—Larson & Taylor

[57] ABSTRACT

A pillow is disclosed which is cut from a block of material and which includes a removable insert within the pillow body which is able to be removed to thereby decrease the height of the pillow. The pillow is cut by cutting part of an upper or lower surface, cutting the other of the upper or lower surface, cutting the remaining of part of the upper or lower surface, making a cut into the pillow body, cutting the insert from within the pillow body and by making a cut through the insert to divide the insert into two parts. The cutting is preferably performed in a single cutting pass of a cutting blade.

10 Claims, 1 Drawing Sheet

HEIGHT ADJUSTABLE PILLOW

FIELD OF THE INVENTION

This invention relates to a pillow and in particular to a bed pillow.

BACKGROUND OF THE INVENTION

Many attempts have been made to make pillows adjustable in thickness so that a pillow can be easily converted to suit the requirements of individual users. Such pillows have met with varying degrees of success and a pillow proposed by us in our Australian Patent No. 650051 includes a number of different sections that sit on top of one another which can be removed to change the thickness or height of the pillow as well as the pillow contour.

SUMMARY OF THE INVENTION

This invention provides an alternative pillow and alternative manner of forming the pillow.

The invention may be said to reside in a pillow including:

- a pillow body having an upper surface and a lower surface; and
- a removable insert cut from the pillow body between the upper and lower surfaces, the insert being removable to decrease the height of the pillow.

Since the insert portion is embedded within the pillow it effectively forms part of the pillow and is not merely a separate slab or section which is placed on or below another section of the pillow. In order to reduce the thickness of the pillow the insert section is merely removed from the interior of the pillow thereby reducing its thickness or height.

The invention may also be said to reside in a method of manufacturing a pillow including the steps of:

- cutting a pillow body from a block of material to provide a pillow body having an upper surface and a lower surface and a pair of ends;
- making a cut between the upper surface or the lower surface and an intermediate point within the pillow body; and
- cutting a removable insert from the pillow body between the upper and lower surfaces so that the height of the pillow can be reduced by removing the removable insert from the pillow body.

Preferably the upper and lower surfaces have a corrugated or battlement like shape. However, in other embodiments they could be smooth surfaces.

Preferably the surfaces are contoured to provide a pair of ridges separated by a valley.

BRIEF DESCRIPTION OF THE DRAWINGS

A preferred embodiment of the invention will be described, by way of example, with reference to the accompanying drawings in which.

DESCRIPTION OF THE PREFERRED EMBODIMENTS

Figure 1:
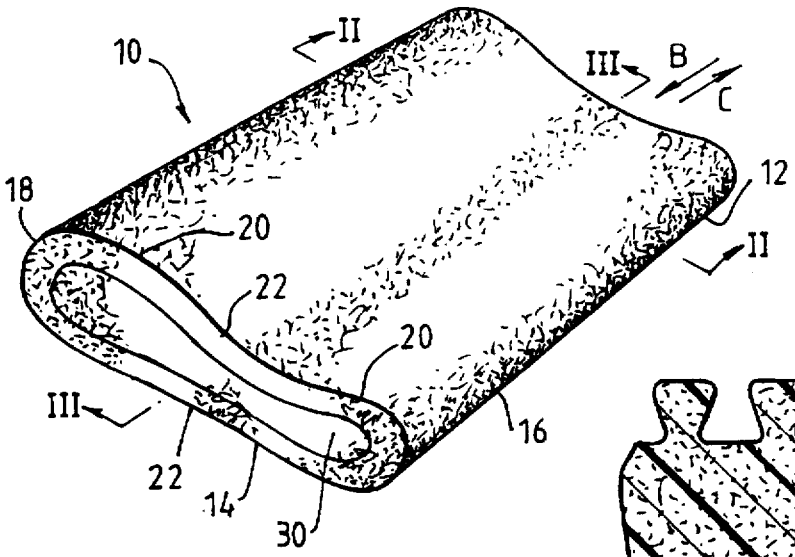
FIG. 1 is a perspective view of a pillow embodying the invention.

With reference to FIG. 1 a pillow 10 is shown which has an upper surface 12 and a lower surface 14. Rounded side portions 16 and 18 join the upper surface 12 to the lower surface 14.

The upper and lower surfaces 12 and 14 are contoured and have a pair of ridges 20 which are separated by valleys 22.

Figure 2:
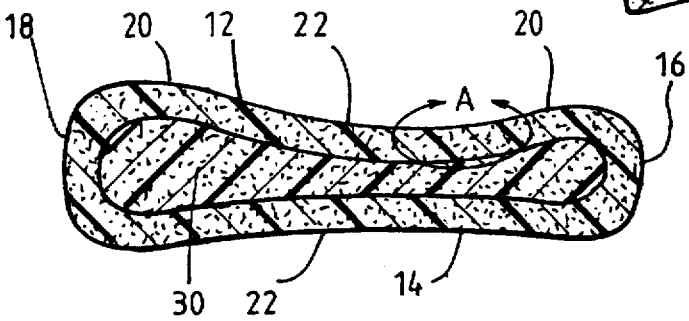
FIG. 2 is a view along the line II—II of FIG. 1.
Figure 3:
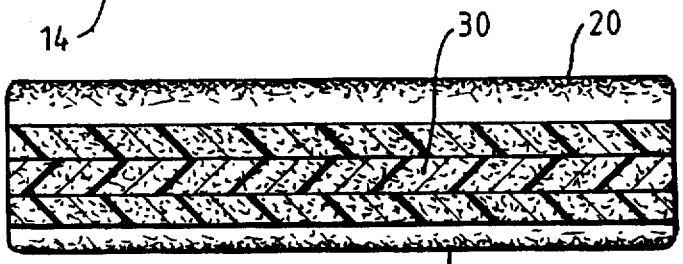
FIG. 3 is a view along the line III—III of FIG. 1.

As best shown in FIGS. 2 and 3 the pillow 10 is provided with an internal insert portion 30 which is cut from the pillow 10 and which is removable from the pillow 10 by drawing the insert out of the pillow 10 in a direction of arrow B or arrow C in FIG. 1.

Figure 4:
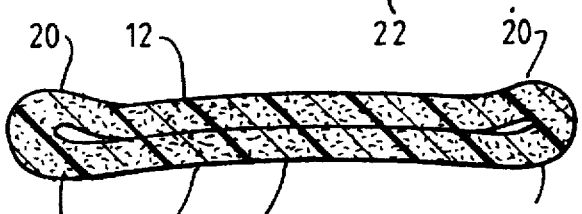
FIG. 4 is a view of the pillow similar to FIG. 2 but with an insert portion removed.

When the insert 30 is withdrawn from the pillow 10 the pillow 10 takes on a thinner or reduced height profile as shown in FIG. 4 to thereby enable the height or thickness of the pillow to be reduced at will by removing the insert portion 30.

The pillow of FIGS. 1 to 4 is preferably made by cutting the pillow from a block of material in a single cycle with a conventional cutting tool. Preferably the block is of foam material and the cutting tool is a saw or blade for cutting foam which is under computer control.

Figure 5:
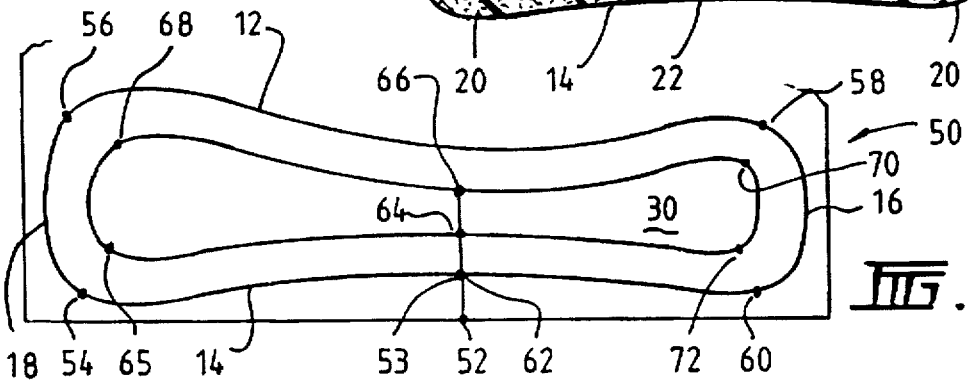
FIG. 5 shows the method of cutting the pillow of FIG. 1 from a body of material.

The pillow is cut from the material by cutting the block of material shown in FIG. 5 in the following manner:

The block of material 50 is firstly cut from a mid-point 52 into the block of material to a point 53. The lower surface 14 is then cut from point 53 to point 54. The side surface 18 is then cut from point 54 to point 56. The upper surface 12 is then cut from point 56 to point 58. The other side surface 16 is cut from point 58 to point 60. The remainder of the bottom surface 14 is cut from point 60 to point 62. The cutting saw then makes a cut inwardly from point 62 to point 64 and then continues to point 65, to point 68, to point 70 to point 72, and then back to point 64 and out of the block of material. Rather than moving the cutting blade out of the block of material, in one embodiment of the invention, a further cut can be made from the point 64 to the point 66 to cut the insert 30 in half. After making the cut to the point 66, the cutting blade can be removed from the block from the point 66, past the points 64 and 52 out of the block of material. Thus, the entire pillow including the insert 30 is cut in a single cycle of the cutting blade under computer control to thereby cut the pillow and the insert 30 from a block of material. The block of material made then further be cut to produce further pillows in the same manner.

Cutting of the insert 30 in half by the cut from the point 64 to the point 66 enables the insert 30 to be removed in three different ways. Firstly, one half of the insert can be removed to reduce the effective height of half of the pillow, secondly the other half of the insert can be removed to reduce the effective height of the other half of the pillow and, thirdly the entire insert 30 (that is both halves) can be removed as previously described to reduce the overall height of the pillow.

Preferably the width of the block of material from which the pillow is cut is selected to be equivalent to the desired length of the pillow so that no cutting of the ends of the pillow is required. If desired the block of material could be pre-cut to provide a block of the desired width to thereby result in pillows of the required length without additional cutting.

Figure 6:
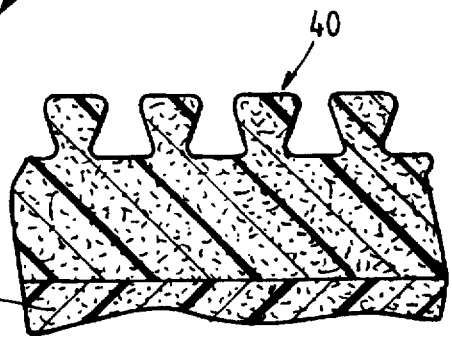
FIG. 6 is a detailed view of the circled portion A of FIG. 2 but showing a different surface profile.

Although in the embodiment of FIGS. 1 to 4 the surface of the pillow is shown as generally smooth, the pillow could have a shaped upper surface 12 and lower surface 14 such as a generally corrugated surface configuration or "battlement type configuration" as shown in FIG. 6. Furthermore, the surfaces could be flat rather than contoured as shown in FIGS. 1 to 4.

Since modifications within the spirit and scope of the invention may readily be effected by persons skilled within the art, it is to be understood that this invention is not limited to the particular embodiment described by way of example hereinabove.

I claim:

1. A pillow including:

a pillow body having an upper surface and a lower surface; and a removable insert cut from the pillow body between the upper and lower surfaces, the insert being physically unattached to the remainder of the pillow body so that the insert is removable to decrease the height of the pillow and reinsertable into the pillow body to readjust the height of the pillow, the removable insert comprising two longitudinal parts longitudinally cut from the removable insert.

2. The pillow of claim 1 wherein the upper and lower surfaces have a corrugated or battlement like shape.

3. The pillow of claim 1 wherein the surfaces are contoured to provide a pair of ridges separated by a valley.

4. The pillow of claim 1, wherein the removable insert is unsymmetrical about a longitudinal line and wherein the two parts extend along the line so that the two parts of the removable insert are of different shape to one another.

5. A method of manufacturing a pillow including the steps of:

cutting out from a block of material a pillow body having an upper surface, a lower surface, and a pair of ends;

cutting a removable insert from the pillow body between the upper and lower surfaces;

cutting the removable insert into two parts; and maintaining the two parts within the pillow but physically unconnected to the pillow so that the two parts are separately removable therefrom to decrease the height of the pillow and reinsertable into the pillow to increase the height of the pillow.

6. The method of claim 5, wherein cutting the removable insert further comprises moving a cutting line, from a starting line located between (1) either of the upper surface or lower surface and (2) an intermediate location in the pillow body, said starting line extending between the pair of ends, and then moving said cutting line around and within the pillow body back to said starting line so as to form said removable insert.

7. The method of claim 6, wherein the block of material is cut to form both the upper and lower surfaces of the pillow body.

8. The method of claim 7, wherein the cut through the pillow body and back to said intermediate point includes a cut extending generally parallel to the upper surface of the pillow body and a cut extending generally parallel to the lower surface of the pillow body.

9. The method of claim 6, wherein the pillow body and removable insert are cut in a single cutting operation comprising making a cut into the block of material, cutting a first portion of the upper or lower surface, cutting the other of the upper or lower surface, cutting the remaining portion of the said upper or lower surface, making the cut from the upper surface or the lower surface into the pillow body to the intermediate location within the pillow body, making a cut around and within the pillow body and back to the said intermediate location within the pillow body to thereby cut the removable insert from the pillow body.

10. The method of claim 9 wherein said single cutting operation cuts said removable insert into said two parts.

* * * * *